US009310071B2

(12) United States Patent
Duignan et al.

(10) Patent No.: US 9,310,071 B2
(45) Date of Patent: Apr. 12, 2016

(54) COMBUSTION CHAMBER FOR BURNING SOLID FUELS

(76) Inventors: Francis Donal Duignan, Dublin (IE); Michael Patrick O'Halloran, Dublin (IE)

( * ) Notice: Subject to any disclaimer, the term of this patent is extended or adjusted under 35 U.S.C. 154(b) by 927 days.

(21) Appl. No.: 12/526,571

(22) PCT Filed: Feb. 14, 2008

(86) PCT No.: PCT/IE2008/000012

§ 371 (c)(1),
(2), (4) Date: Aug. 10, 2009

(87) PCT Pub. No.: WO2008/099373

PCT Pub. Date: Aug. 21, 2008

(65) Prior Publication Data

US 2010/0037806 A1 Feb. 18, 2010

(30) Foreign Application Priority Data

Feb. 15, 2007 (IE) ..... 2007/0094

(51) Int. Cl.
*F23B 30/00* (2006.01)
*F23L 9/04* (2006.01)
(Continued)

(52) U.S. Cl.
CPC ... *F23B 1/08* (2013.01); *F23B 1/26* (2013.01); *F23B 1/36* (2013.01); *F23B 5/04* (2013.01); *F23B 10/02* (2013.01); *F23B 50/12* (2013.01);
(Continued)

(58) Field of Classification Search
CPC ..... F23B 5/02; F23B 5/04; F23B 10/00; F23B 10/02; F23B 90/04; F23B 90/06; F23B 90/08; F23C 6/04; F23C 6/045; F23C 2201/10; F23C 1/14; F23L 9/00; F23L 9/02; F23L 9/04; F23J 15/00; F23J 2219/10; F23G 2202/60
USPC ..... 110/229, 230, 208, 211, 214, 297, 235; 126/7, 10, 15 R, 15 A, 68, 73, 76, 77, 126/103, 106, 107, 112, 146
See application file for complete search history.

(56) References Cited

U.S. PATENT DOCUMENTS 3,543,700 A * 12/1970 Devita et al. ..... 110/213
3,769,922 A * 11/1973 Furlong et al. ..... 110/263
(Continued)

FOREIGN PATENT DOCUMENTS

DE 4215508 5/1993
DE 9218953 7/1996
(Continued)

*Primary Examiner* — David J Laux
(74) *Attorney, Agent, or Firm* — Larson & Anderson, LLC

(57) ABSTRACT

A combustion chamber (10) for burning solid fuels having a high volatiles content has a hollow body (11) with a cylindrical wall section (12) and a top section (13) located at end (14) of the cylindrical wall section (12). The hollow body (11) has a primary air inlet (20), a fuel inlet (23) and four volatiles outlets (25) (one shown), mounted therein. Each volatiles outlet (25) has a plurality of apertures (26) of differing sizes arranged in a plate (27). In use, the burning volatiles exit the apertures (26) in a turbulent flow resulting in efficient combustion of the volatiles. Additionally, a heat transferring surface (33) on a water jacket (32) is shaped around the combustion chamber (10) so as to define a channel (34) there between. This arrangement results in an efficient transfer of heat from the turbulent flow of volatiles, which is forced to circulate around the channel (34).

21 Claims, 4 Drawing Sheets

(51) Int. Cl.

| | |
|---|---|
| ***F23B 10/02*** | (2011.01) |
| ***F23B 50/12*** | (2006.01) |
| ***F23B 80/04*** | (2006.01) |
| ***F23B 50/00*** | (2006.01) |
| ***F23B 60/02*** | (2006.01) |

(52) U.S. Cl.
CPC ..... *F23B 60/02* (2013.01); *F23B 80/04* (2013.01); *F23L 9/04* (2013.01)

(56) References Cited

U.S. PATENT DOCUMENTS

| | | | | |
|---|---|---|---|---|
| 4,233,914 | A | 11/1980 | Schuette et al. | |
| 4,375,949 | A * | 3/1983 | Salooja | 431/7 |
| 4,515,093 | A * | 5/1985 | Beardmore et al. | 110/347 |
| 4,565,184 | A | 1/1986 | Collins et al. | |
| 5,200,155 | A * | 4/1993 | Obermueller | 110/203 |
| 5,243,963 | A | 9/1993 | Riener | |
| 5,284,103 | A * | 2/1994 | Hand et al. | 110/255 |
| 5,413,089 | A * | 5/1995 | Andors et al. | 110/210 |
| 7,942,666 | B2 * | 5/2011 | Freller | 110/254 |
| 2007/0089733 | A1 | 4/2007 | Bast | |

FOREIGN PATENT DOCUMENTS

| | | |
|---|---|---|
| JP | 57204715 | 12/1982 |
| WO | 2008001276 A2 | 1/2008 |

* cited by examiner

COMBUSTION CHAMBER FOR BURNING SOLID FUELS

This application is the national stage of PCT/IE2008/000012 filed Feb. 14, 2008.

TECHNICAL FIELD

This invention relates to a combustion chamber for burning solid fuels having a volatiles content and, in particular, to a combustion chamber for burning solid fuels having a high volatiles content, and also to a fire chamber incorporating such a combustion chamber.

By solid fuels having a high volatiles content in this context is meant solid fuels such as wood pellets, pellets made from switchgrass, miscanthus, maize stalks, straw or the like, and nut shells such as almond shells, all collectively referred to as solid biomass fuels, and also fossil fuels such as peat or bituminous coal. In contrast, an example of a low volatiles solid fuel would be anthracite coal.

BACKGROUND ART

In recent years, worldwide concern has arisen relating to climatic changes ascribed to the increase in atmospheric carbon dioxide released by fossil fuels. The price of such fuels has been increasing, and projections as to the remaining world supplies of such fossil fuels have led to increased interest in the development of devices utilising alternative fuels. Furthermore, use of renewable fuels in such devices could slow down the increase in carbon dioxide levels in the atmosphere.

Devices, which burn wood are known. However, cord wood burns inefficiently in conventional combustion chambers and is inconvenient to use in comparison with oil or gas burning devices.

The use of biomass fuels is also increasing. However, again, biomass fuel tends to burn inefficiently in conventional devices and this is due to its high volatiles content. Much of the heat is released into the burning gases (the flames) and is lost up the chimney or flue.

Another reason that conventional boilers and stoves are unsuitable for burning pelleted biomass fuels such as wood pellets, wood chips, etc., is that such pellets tend to smoulder at reduced output particularly when they have a relatively high moisture content. Consequently devices have been developed for burning these fuels more efficiently.

Thus, for example, a typical wood pellet stove includes a hopper, an auger, a firebox or grate, a combustion fan and a heat exchanger which, respectively, store, feed, burn the fuel and transfer the heat to the space to be heated. The auger operates in a timed manner to control the delivery of the pellet fuel from the hopper into the firebox. The rate of delivery of the fuel to the firebox is matched to the rate of consumption of the fuel for a particular output. The combustion fan provides a measured amount of air to the firebox. An example of such a stove is the Pellet stove Mod. 1000 manufactured by Caminetti Montegrappa s.r.l of via A. da Bassano, 7/9, 36020 Pove Del Grappa (VI), Italy.

However, a problem with such stoves and boilers is that the transfer of heat from the burning volatiles is relatively low, particularly at low output, and acceptably high efficiencies can only be achieved by passing the flue gases through extensive heat exchangers.

German Patent Publication No. DE 92 18 953 describes a pellet burning stove in which the pellets are burned in an open burner pan located at the base of a combustion chamber.

Complete combustion of the pellets is achieved in the combustion chamber, and the hot exhaust gases exit through holes in the top of the combustion chamber and are directed through a heat exchanger to extract the heat therefrom.

U.S. Patent Application Publication No. 2007/0089733 describes a wood-burning boiler having a combustion chamber with an air intake and an exhaust chamber connected to the combustion chamber for receiving burnt gases through an exhaust opening therein. The boiler includes first and second air preheat chambers from which secondary air is introduced into the combustion chamber through a plurality of holes. The exhaust chamber is positioned next to the second air preheat chamber such that in use heat from the exhaust gases is transferred to the air in the preheat chamber before the exhaust gases pass from the exhaust chamber into an exhaust passage where further heat is extracted by means of a water jacket surrounding the exhaust passage.

It is an object of the present invention to overcome the disadvantages of the devices hereinbefore described.

DISCLOSURE OF INVENTION

Accordingly, the invention provides a combustion chamber for burning solid fuels having a high volatiles content, the combustion chamber comprising an enclosed hollow body in which the fuel is to be burnt, the body having a fuel inlet, a primary air inlet, a secondary air inlet and a burning volatiles outlet mounted therein, the burning volatiles outlet having a plurality of apertures, such that, in use, the burning volatiles exit the apertures in a turbulent flow resulting in efficient combustion of the volatiles.

An advantage of the combustion chamber according to the invention is that the volatiles have to exit the chamber via the apertures in the volatiles outlet and this causes an increase in the velocity of the burning volatiles as they exit. It also causes the turbulent flow of volatiles. The result is that the volatiles burn more efficiently and at a higher temperature than is achieved in a conventional device burning the same fuel. A consequence of this greater efficiency is that the levels of harmful products, such as the nitrous oxides, in the flue gases are reduced relative to known devices.

A combustion chamber according to the invention can be used in devices such as boilers, air heaters and stoves, in hotplates, in devices for providing a source of heat for an industrial process, in an incinerator or the like.

Preferably, the apertures are of differing sizes.

Having apertures of differing sizes in the volatiles outlet results in more efficient mixing of the volatiles in the turbulent flow leading to more efficient combustion.

The apertures can be arranged in a particular pattern so as to optimise the performance of the combustion chamber in a particular application.

Further, preferably, the secondary air inlet is adjacent the burning volatiles outlet.

The positioning of the secondary air inlet can be important for a particular application of the combustion chamber and such positioning will affect the characteristics of the turbulent flow exiting from the volatiles outlet.

In one embodiment of the invention the burning volatiles outlet has means for temporarily restricting the flow of burning volatiles therethrough.

An advantage of the restricting means is that efficient combustion can be maintained at varying outputs. Thus, at low output the burning volatiles outlet can be restricted so as to maintain a turbulent flow of volatiles therethrough.

Preferably, upstanding formations on the outer surface of the body adjacent the apertures are shaped so as to direct the emerging burning volatiles along the outer surface.

By diverting the burning volatiles along the outer surface of the body the body is maintained at a higher temperature which leads to more efficient combustion of the fuel. This is a requirement at low output particularly when the fuel has a relatively high moisture content.

In circumstances where the problem of high moisture content in the fuel is acute, the primary air can also be preheated by the burning volatiles by passing the primary air supply duet through or against the burning volatiles.

In a further embodiment of the invention, two or more burning volatiles outlets are mounted in the hollow body.

The provision of a number of burning volatiles outlets results in more even distribution of the heat from the burning fuel.

This arrangement also lends itself to maximising the efficiency of the combustion chamber at all available outputs, while restricting the emission of oxides of nitrogen by reducing the peak temperature of combustion.

In another aspect of the invention there is provided a fire chamber for a device for burning solid fuels having a high volatiles content, the fire chamber comprising a housing, a combustion chamber within the housing, the combustion chamber having an enclosed hollow body in which the fuel is to be burnt, the body having a fuel inlet, a primary air inlet, a secondary air inlet and a burning volatiles outlet mounted therein, means associated with the burning volatiles outlet for tabulating the burning volatiles as they exit therefrom, in use the housing having an inner heat transferring surface shaped about the combustion chamber so as to define a channel therebetween, such that, in use, the burning volatiles exiting the burning volatiles outlet are forced to circulate around the combustion chamber within the channel in a turbulent flow resulting in efficient combustion of the volatiles.

By employing the combustion chamber with a burning volatiles outlet, from which the burning volatiles emerge in a turbulent flow, the fire chamber is heated more efficiently than a conventional fire chamber consuming a similar amount of fuel.

An advantage of this arrangement is that the heat released by the volatiles is transferred both to the heat transferring surface and back into the combustion chamber. This provides a means for increasing the temperature of the zone into which the fresh fuel is introduced, particularly at low output, resulting in an increase in the overall temperature of combustion.

In one embodiment of the fire chamber according to the invention, a set of upstanding curved formations is mounted on the inner heat transferring surface around the combustion chamber within the channel.

The shape and positioning of the set of upstanding curved formations within the channel further directs the circulation of the volatiles around the combustion chamber and also enhances the turbulent flow of the volatiles.

In a further embodiment of the fire chamber according to the invention, the turbulating means is a plurality of apertures within the burning volatiles outlet.

Preferably, the apertures are of differing sizes.

In a further embodiment of the fire chamber according to the invention, the secondary air inlet is adjacent the burning volatiles outlet.

In a further embodiment of the fire chamber according to the invention the burning volatiles outlet has means for temporarily restricting the flow of burning volatiles therethrough.

Preferably, upstanding formations on the outer surface of the body adjacent the apertures are shaped so as to direct the emerging burning volatiles along the outer surface.

In a further embodiment of the fire chamber according to the invention, two or more burning volatiles outlets are mounted in the hollow body.

This arrangement results in the efficient circulation of the burning volatiles around the combustion chamber.

At certain outputs, the tail of the flame emerging from each burning volatiles outlet will run into the flame emerging from the next burning volatiles outlet. This arrangement can provide a means for achieving complete combustion at the tail of each flame. It can also cause a reduction in the peak temperature of combustion, thereby preventing the formation and emission of nitrous oxides.

Preferably, the burning volatiles outlets are arranged equidistantly around the surface of the hollow body.

The equidistant arrangement of the burning volatiles outlets optimises the flame merging effect described above.

Alternatively, the burning volatiles outlets are positioned about the surface of the hollow body so as to facilitate the optimisation of the turbulent flow of burning volatiles thereabout for each output setting.

Thus, for a particular output setting the volatiles flow through a selected number of the burning volatiles outlets could be restricted so as to optimise the flame merging effect while minimising the emission of nitrous oxides, In a further embodiment of the fire chamber in accordance with the invention, means for moving the combustion chamber towards and away from the inner heat transferring surface is provided.

An advantage of this arrangement is that when a low output is required the combustion chamber can be moved closer to the inner heat transferring surface. This has the effect of restricting the flow of volatiles through the burning volatiles outlet. Conversely, when a higher output is required the combustion chamber can be moved further away from the inner heat transferring surface.

In a further embodiment of the fire chamber in accordance with the invention, the combustion chamber is positioned at the top of the fire chamber, the burning volatiles outlet is mounted in the upper region of the combustion chamber, and an exhaust gases outlet is mounted in the housing below the combustion chamber, such that, in use, the burning volatiles, as they exit the burning volatiles outlet circulate around the top of the combustion chamber in the channel until they start to cool and consequently drop down in the channel, with the exhaust gases exiting the chamber through the exhaust gases outlet.

BRIEF DESCRIPTION OF THE DRAWINGS

The invention will be further illustrated by the following description of embodiments thereof, given by way of example only with reference to the accompanying drawings in which.

MODES FOR CARRYING OUT THE INVENTION

Figure 1:
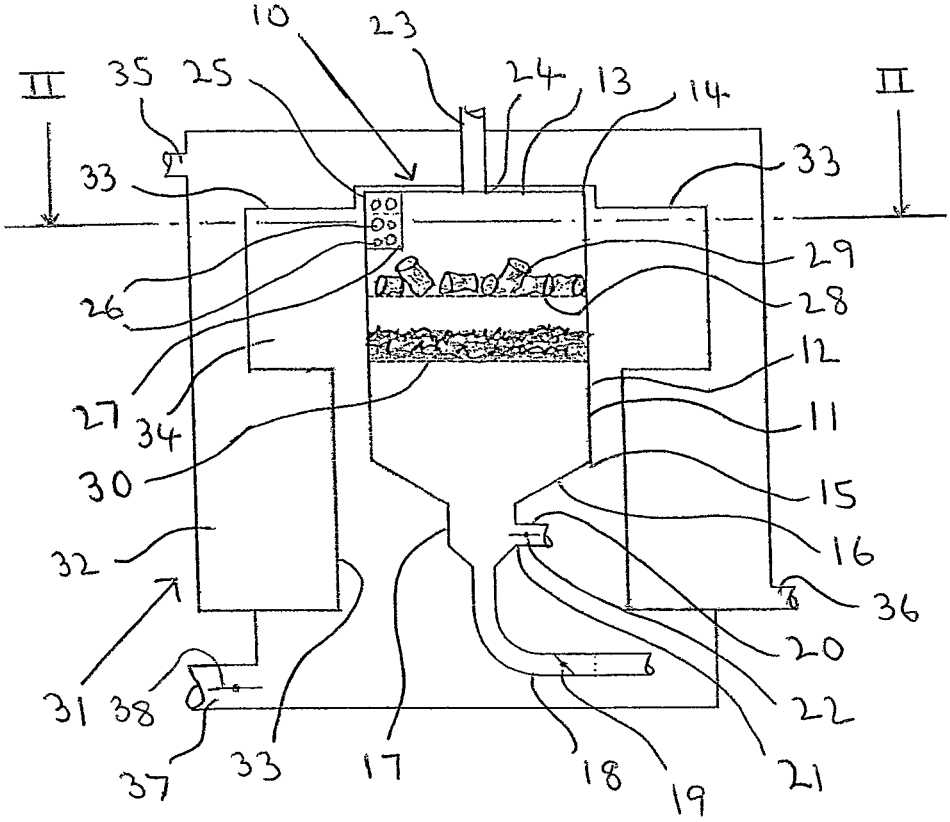
FIG. 1 is a vertical section through a boiler containing a combustion chamber and a fire chamber in accordance with the invention.

Referring to FIG. 1 there is illustrated, generally at 10, a combustion chamber in accordance with the invention, the combustion chamber 10 having an enclosed hollow body 11, which is generally circular in cross-section. The hollow body 11 has a cylindrical wall section 12, and a top section 13 at end 14 of the cylindrical wall section 12. The cylindrical wall section 12 narrows at end 15 to form a frusto-conical section 16, which terminates in a neck section 17, within which the ash collects in use to be removed through an exit pipe 18, which is regulated by a valve 19.

A primary air inlet 20 is connected to the neck section 17 at point 21 and is regulated by a valve 22 housed therein.

A fuel inlet 23 is mounted in the top section 13 at point 24 and in this embodiment the fuel inlet 23 also acts as a secondary air inlet.

Four burning volatiles outlets 25 (one visible) are mounted in the cylindrical wall section 12, adjacent the top section 13. Each burning volatiles outlet 25 has a plurality of apertures 26 of differing sizes arranged in a plate 27. The plate 27 is made of tungsten to withstand the heat generated in use.

A grate 28 is mounted within the hollow body 11 and supports the wood pellets 29 to be burnt. As the wood pellets 29 burn, they break up, fall through the grate 28 and are held on a mesh 30 while they burn for a further period, until they finally fall through the mesh 30 as ash (not shown), to be collected in the neck section 17.

In the embodiment illustrated the combustion chamber 10 forms part of a fire chamber, shown generally at 31, in accordance with the invention. The fire chamber 31 has a water jacket 32 having a heat transfer surface 33 which encircles the combustion chamber 10. Around the area of cylindrical section 12, in which the burning volatiles outlets 25 are mounted, the heat transfer surface 33 is formed so as to create a channel 34 between the heat transfer surface 33 and the cylindrical section 12.

The water jacket 32 has a water inlet 35 and a water outlet 36.

In use the wood pellets 29 are introduced into the combustion chamber 10 through the fuel inlet 23 at a rate appropriate for the required heat output of the device. Primary air at the appropriate pressure is introduced into the combustion chamber 10 via the primary air inlet 20 and is blown up through the mesh 30, the grate 28 and the pellets 29. Thus, the primary combustion takes place above the grate 28 in the area of the top section 13. Again, depending on the output required, secondary air is introduced into the combustion chamber 10 through the fuel inlet 23 and mixes with the volatiles above the pellets 29. The burning volatiles then exit the combustion chamber 10 through the burning volatiles outlets 25 in a turbulent flow and circulate around the cylindrical section 12 raising the temperature of both the heat transfer surface 33 and the combustion chamber 10 itself.

Thus, the burning of the volatiles is concentrated in the area above the pellets 29 and in the channel 34. The burning volatiles will remain in this area due to thermal buoyancy until they, start to cool. As the volatiles cool they drop down in the combustion chamber 10 and the exhaust gases are vented through a flue 37, which is regulated by a paddle valve 38.

Figure 2:
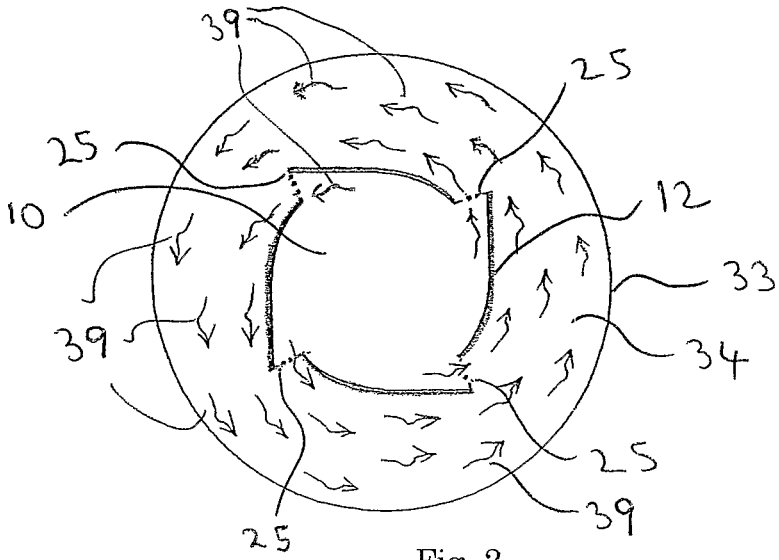
FIG. 2 is a horizontal section on line of FIG. 1.

Referring to FIG. 2 the arrangement of the volatiles outlets 25 around the cylindrical section 12 can be seen more clearly. The arrows 39 indicates the path of the turbulent flow of the volatiles through the channel 34 around the combustion chamber 10. The burning volatiles outlets 25 are offset in the cylindrical section 12 such that the turbulent flow of volatiles, as it exits the volatiles outlets 25 is already directed around the combustion chamber 10, as desired.

Figure 3:
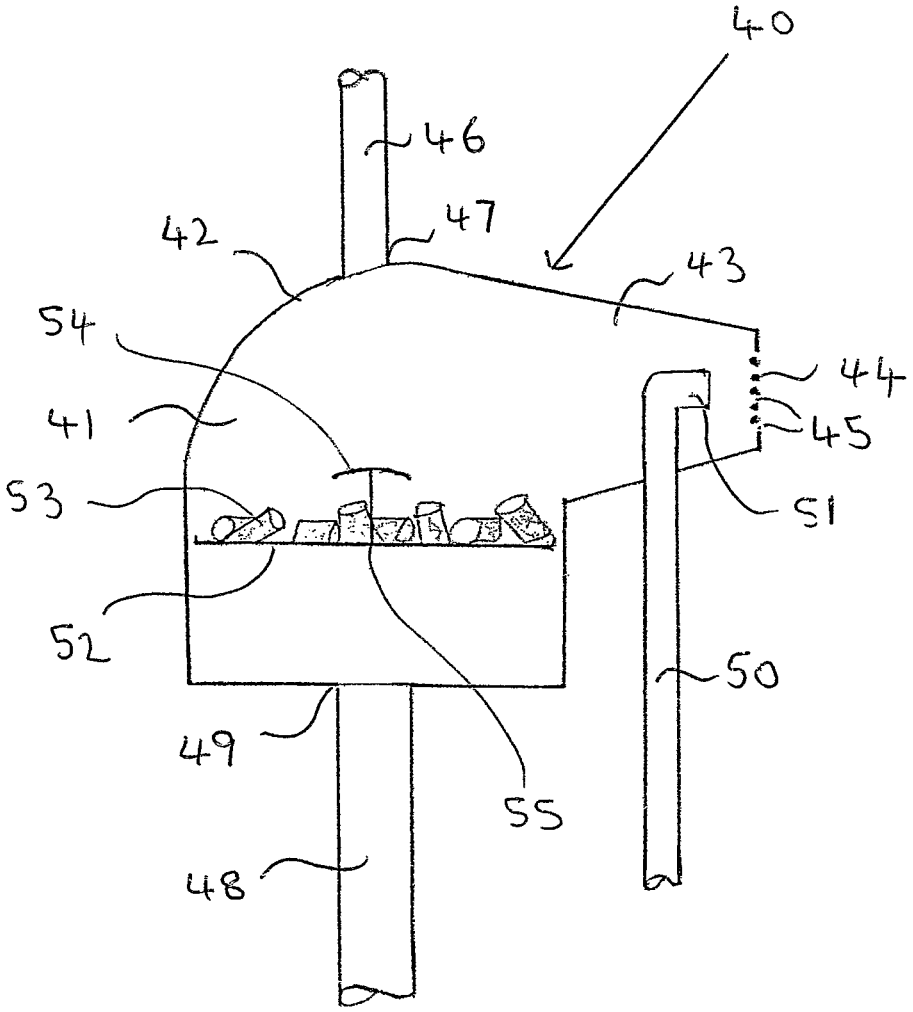
FIG. 3 is a vertical section through a second embodiment of a combustion chamber in accordance with the invention.

Referring to FIG. 3 there is illustrated, generally at 40, a second embodiment of a combustion chamber in accordance with the invention. The combustion chamber 40 is designed to burn wood pellets and to provide a blown flame and is suitable for use as a replacement for an oil burner in an oil-fired heating boiler.

The combustion chamber 40 has an enclosed hollow body 41, which has a generally circular cross-section and a domed top section 42. A frusto-conical section 43 extends laterally from the top section 42 and terminates in a volatiles outlet 44 having a plurality of apertures 45. A fuel inlet 46 is located at point 47 on the top section 42 and a primary air inlet 48 is located at point 49 on the body section 41, A secondary air inlet 50 is mounted in the frusto-conical section 43 and is positioned such that a secondary air nozzle 51 is located, within the hollow body 41, adjacent the volatiles outlet 44.

A grate 52 is mounted within the hollow body 41 and supports the wood pellets 53 to be burnt. A drop-on umbrella shaped plate 54 is mounted centrally on the grate 52 at position 55 below the fuel inlet 46. In use, the drop-on plate 54 prevents the burning wood pellets 53 from being crushed by fresh pellets 53 dropping from the fuel inlet 46 and also helps to disperse the pellets 53 over the grate 52.

In use, the burning of the pellets 53 on the grate 52 results in burning volatiles above the grate 52. These volatiles mixed with the primary and secondary air are forced through the apertures 45 of the burning volatiles outlet 44 and exit as a rapidly burning turbulent flow, which can be directed onto a heat transferring surface within the fire chamber of the heating boiler.

Figure 4:
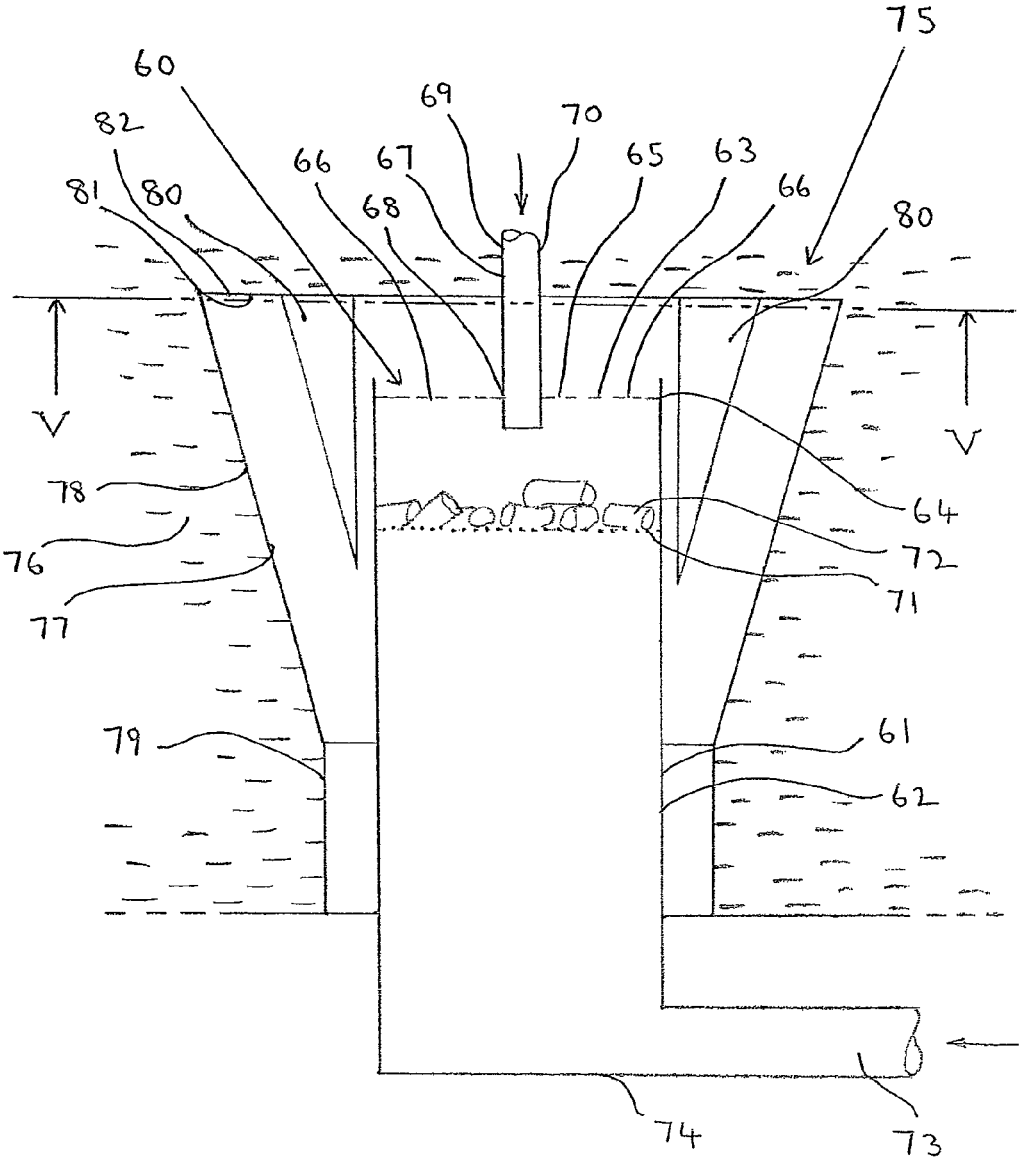
FIG. 4 is a vertical section through a third embodiment of a combustion chamber in accordance with the invention.

Referring to FIG. 4 there illustrated generally at 60, a third embodiment of a combustion chamber in accordance with the invention, the combustion chamber 60 having an enclosed hollow body 61, which is generally circular in cross-section. The hollow body 61 has a cylindrical wall section 62 and a top section 63 at end 64 of the cylindrical section 62.

A burning volatiles outlet 65 is mounted in the top section 63 and has a plurality of apertures 66 therein, A pipe 67 passes through a central opening 68 in the top section 63. The pipe 67 serves as a fuel inlet 69 and a secondary air inlet 70.

A grate 71 is mounted within the hollow body 61 and supports the wood pellets 72 to be burnt.

A primary air inlet 73 is mounted at the bottom end 74 of the hollow body 61.

In the embodiment illustrated the combustion chamber 60 forms part of a fire chamber, shown generally at 75, in accordance with the invention. The fire chamber 75 has a water jacket 76 having an inner heat transferring surface 77 which encircles the combustion chamber 60. The inner heat transferring surface 77 has an upper section 78, which has an inverted frusta-conical shape and a lower cylindrical section 79.

Figure 5:
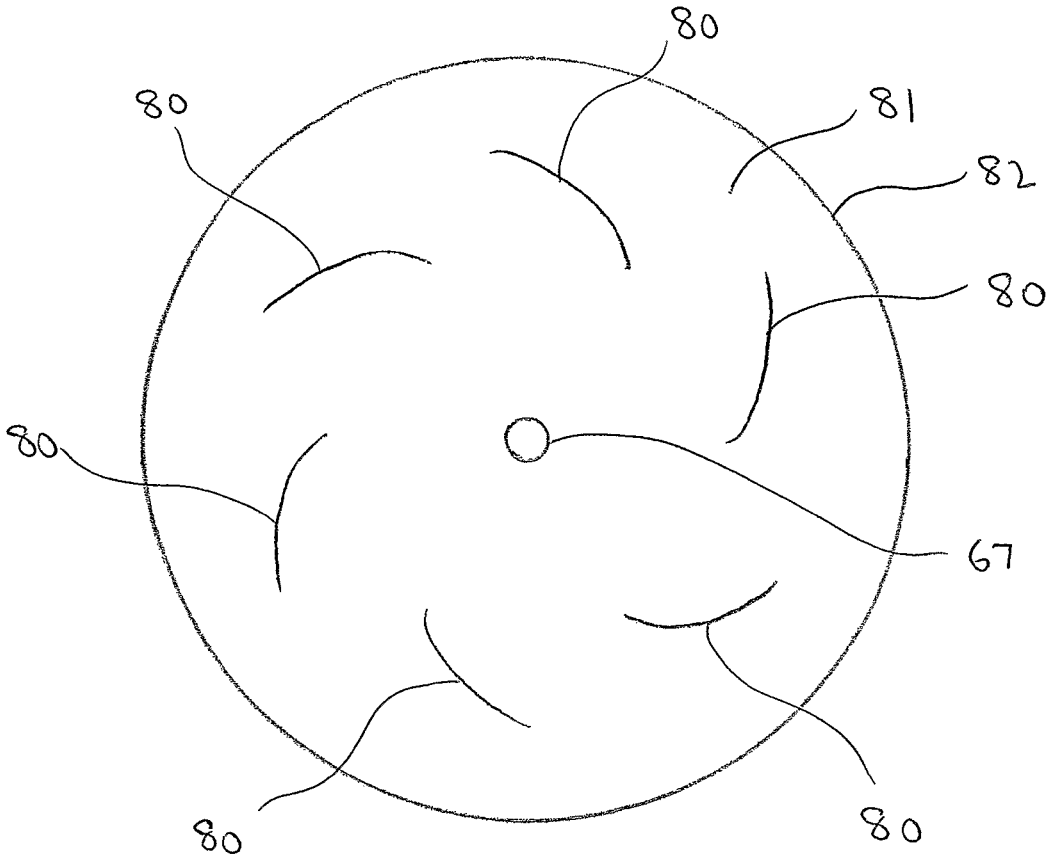
FIG. 5 is a horizontal section on line V-V of FIG. 4.

A set of upstanding curved formations 80 is mounted on an internal surface 81 of a top section 82 of the inner heat transferring surface 77. The set of upstanding curved formations 80 is arranged equidistantly around the combustion chamber 60 and this can be more clearly seen with reference to FIG. 5.

A means (not shown) for moving the combustion chamber along its vertical axis is provided. Thus, when a low output is required the combustion chamber 60 can be moved closer to the top section 82 of the inner heat transferring surface 77. This has the effect of restricting the flow of volatiles through the volatiles outlet 65. Conversely, when a higher output is required the combustion chamber 60 can be moved further away from the top section 82 of the inner heat transferring surface 77.

In use the wood pellets 71 are introduced into the combustion chamber 60 through the fuel inlet 69 at a rate appropriate for the required heat output of the device. Primary air at the appropriate pressure is introduced into the combustion chamber 60 via the primary air inlet 73 and is blown up through the grate 71 and the pellets 72. Thus, the primary combustion takes place above the grate 71. Again, depending on the output required, secondary air is introduced into the combustion chamber 60 through the secondary air inlet 70 and mixes with the volatiles above the pellets 72. The burning volatiles then exit the combustion chamber 60 through the burning volatiles outlet 65 in a turbulent flow and circulate around the fire chamber 75 raising the temperature of both the inner heat transferring surface 77 and the combustion chamber 60 itself.

The shape and positioning of the set of upstanding curved formations 80 within the fire chamber 75 causes the volatiles to circulate around the combustion chamber 60 and also enhances the turbulent flow of the volatiles. As the volatiles cool they drop down to the end 74 of the combustion chamber 60, where they pass through an exit pipe (not shown).

The invention claimed is:

1. A fire chamber for a device for burning solid fuels having a high volatiles content, the fire chamber comprising a housing, a combustion chamber within the housing, the combustion chamber having an enclosed hollow body in which the fuel is to be burnt, the body having a fuel inlet, a primary air inlet providing primary air of combustion to the combustion chamber, a secondary air inlet providing secondary air of combustion to the combustion chamber, and a burning volatiles outlet mounted therein, wherein a means for turbulating is associated with the burning volatiles outlet such that, in use, the confluence of burning volatiles and secondary air of combustion is turbulated on entering the housing, resulting in efficient turbulated combustion of the volatiles within the housing, the housing having an inner heat transferring surface shaped about the combustion chamber so as to define a channel therebetween, such that, in use, the turbulated confluence of burning volatiles and secondary air exiting the burning volatiles outlet is forced to circulate around the combustion chamber within the channel in a turbulent flow resulting in efficient combustion of the volatiles, wherein a set of upstanding curved formations is mounted on the inner heat transferring surface around the combustion chamber within the channel, and configured to cause burning volatiles to circulate within the channel.

2. A fire chamber according to claim 1, wherein the turbulating means is a plurality of apertures within the burning volatiles outlet.

3. A fire chamber according to claim 2, wherein the apertures are of differing sizes.

4. A fire chamber according to claim 2, wherein upstanding formations on the outer surface of the body adjacent the apertures are shaped so as to direct the emerging burning volatiles to circulate around the body.

5. A fire chamber according to claim 1, wherein two or more burning volatiles outlets are mounted in the hollow body.

6. A fire chamber according to claim 5, wherein the burning volatiles outlets are arranged equidistantly around the surface of the hollow body.

7. A fire chamber according to claim 5, wherein the burning volatiles outlets are positioned about the surface of the hollow body so as to facilitate the optimisation of the turbulent flow of burning volatiles thereabout for more than one output setting.

8. A fire chamber according to claim 1, wherein the combustion chamber is positioned at the top of the fire chamber, the burning volatiles outlet is mounted in the upper region of the combustion chamber, and an exhaust gases outlet is mounted in the housing below the combustion chamber, such that, in use, the burning volatiles, as they exit the burning volatiles outlet circulate around the top of the combustion chamber in the channel until they start to cool and consequently drop down in the channel, with the exhaust gases exiting the chamber through the exhaust gases outlet.

9. A fire chamber according to claim 1, wherein the secondary air inlet is adjacent the burning volatiles outlet.

10. A fire chamber for a device for burning solid fuels having a high volatiles content, the fire chamber comprising a housing, a combustion chamber within the housing, the combustion chamber having an enclosed hollow body in which the fuel is to be burnt, the body having a fuel inlet, a primary air inlet providing primary air of combustion to the combustion chamber, a secondary air inlet providing secondary air of combustion to the combustion chamber, and a burning volatiles outlet mounted therein, and wherein a means for turbulating is associated with the burning volatiles outlet such that, in use, the confluence of burning volatiles and secondary air of combustion is turbulated on entering the housing, resulting in efficient turbulated combustion of the volatiles within the housing, the housing having an inner heat transferring surface shaped about the combustion chamber so as to define a channel therebetween, such that, in use, the turbulated confluence of burning volatiles and secondary air exiting the burning volatiles outlet is forced to circulate around the combustion chamber within the channel in a turbulent flow resulting in efficient combustion of the volatiles, wherein two or more burning volatiles outlets are mounted in the hollow body, and wherein the burning volatiles outlets are positioned and orientated about the surface of the hollow body so as to induce the burning volatiles to circulate around the hollow body and thereby facilitate the optimisation of the turbulent flow of burning volatiles thereabout for more than one output setting.

11. A fire chamber according to claim 10, wherein the secondary air inlet is adjacent the burning volatiles outlet.

12. A fire chamber according to claim 10, wherein the turbulating means is a plurality of apertures within the burning volatiles outlet.

13. A fire chamber according to claim 10, wherein the apertures are of differing sizes.

14. A fire chamber according to claim 10, wherein the burning volatiles outlets are arranged equidistantly around the surface of the hollow body.

15. A fire chamber for a device for burning solid fuels having a high volatiles content, the fire chamber comprising a housing, a combustion chamber within the housing, the combustion chamber having an enclosed hollow body in which the fuel is to be burnt, the body having a fuel inlet, a primary air inlet providing primary air of combustion to the combustion chamber, a secondary air inlet providing secondary air of combustion to the combustion chamber, and a burning volatiles outlet mounted therein, and wherein a means for turbulating is associated with the burning volatiles outlet such that, in use, the confluence of burning volatiles and secondary air of combustion is turbulated on entering the housing, resulting in efficient turbulated combustion of the volatiles within the housing, the housing having an inner heat transferring surface shaped about the combustion chamber so as to define a channel therebetween, such that, in use, the turbulated confluence of burning volatiles and secondary air exiting the burning volatiles outlet is forced to circulate around the combustion chamber within the channel in a turbulent flow resulting in efficient combustion of the volatiles, and wherein the combustion chamber is positioned at the top of the fire chamber, the burning volatiles outlet is mounted in the upper region of the combustion chamber, and an exhaust gases outlet is mounted in the housing below the combustion chamber, such that, in use, the burning volatiles, as they exit the burning volatiles outlet circulate around the top of the combustion chamber in the channel until they start to cool and consequently drop down in the channel, with the exhaust gases exiting the chamber through the exhaust gases outlet.

16. A fire chamber according to claim 15, wherein the secondary air inlet is adjacent the burning volatiles outlet.

17. A fire chamber according to claim 15, wherein the turbulating means is a plurality of apertures within the burning volatiles outlet.

18. A fire chamber according to claim 15, wherein the apertures are of differing sizes.

19. A fire chamber according to claim 15, wherein the burning volatiles outlets are arranged equidistantly around the surface of the hollow body.

20. A fire chamber according to claim 15, wherein two or more burning volatiles outlets are mounted in the hollow body.

21. A fire chamber according to claim 20, wherein the burning volatiles outlets are positioned about the surface of the hollow body so as to facilitate the optimisation of the turbulent flow of burning volatiles thereabout for more than one output setting.

* * * * *